US005680141A

United States Patent [19]

Didomenico et al.

[11] Patent Number: 5,680,141

[45] Date of Patent: Oct. 21, 1997

[54] TEMPERATURE CALIBRATION SYSTEM FOR A FERROELECTRIC PHASE SHIFTING ARRAY ANTENNA

[75] Inventors: Dale M. Didomenico, Interlaken; Thomas E. Koscica, Clark; William C. Drach, Tinton Falls, all of N.J.

[73] Assignee: The United States of America as represented by the Secretary of the Army, Washington, D.C.

[21] Appl. No.: 455,762

[22] Filed: May 31, 1995

[51] Int. Cl.[6] ..... H01Q 3/22; H01Q 3/24; H01Q 3/26

[52] U.S. Cl. ..... 342/372; 342/157; 342/174

[58] Field of Search ..... 342/372, 154, 342/157, 174

[56] References Cited

U.S. PATENT DOCUMENTS

| | | | |
|---|---|---|---|
| H173 | 12/1986 | Claborn et al. | 342/372 |
| 5,107,273 | 4/1992 | Roberts | 342/417 |
| 5,218,358 | 6/1993 | Harrington et al. | 342/372 |
| 5,353,031 | 10/1994 | Rathi | 342/372 |

*Primary Examiner*—Theodore M. Blum

*Attorney, Agent, or Firm*—Michael Zelenka; William H. Anderson

[57] ABSTRACT

Telecommunication systems and methods for driving a phased-array antenna having a plurality of spaced antenna elements that radiate and receive a beam of radio frequency signals. Each of a plurality of ferroelectric phase shifters connect to a different one of the antenna elements. A signal processor system, having a receiver and a frequency synthesizer communicates with the phase shifters under the control of a data processor system. A joystick connects to the data processor system for permitting manual input of beam steering information thereto. The data processor system responds to the joystick inputs by controlling the relative phase shifts of the signals propagating in the ferroelectric phase shifters. The system further includes a temperature sensor circuit for sensing the temperature of each of the ferroelectric phase shifters. This temperature sensor circuit connects to the data processor system for inputting temperature information that the data processor system uses to calculate calibration error factors. The data processor system uses the joystick inputs and the calibration error factors to apply concurrent calibrated analog control voltages to the ferroelectric phase shifters for controlling their relative phase shifts. The joystick permits an operator to manually control the position of the beam in real time, or to effect automatic beam scanning and control the scanning rate.

10 Claims, 2 Drawing Sheets

TEMPERATURE CALIBRATION SYSTEM FOR A FERROELECTRIC PHASE SHIFTING ARRAY ANTENNA

GOVERNMENT INTEREST

The invention described herein may be manufactured, used and licensed by or for the Government for governmental purposes without the payment to us of any royalties thereon.

BACKGROUND OF THE INVENTION

1. Field of the Invention

This invention relates in general to the field of telecommunication systems that employ electronically steerable antennas. More particularly, the invention relates to telecommunication systems having apparatus and methods for controlling, steering and automatically calibrating phase shifters for phased-array antennas.

2. Description of the Prior Art

Many telecommunication systems employ electronically steerable phased-array antennas for forming a narrow beam that can scan a particular field of view. In general, a phased array antenna is an antenna with two or more driven elements. The elements are fed with a certain relative phase, and they are spaced at a certain distance, resulting in a beam pattern that exhibits gain in some directions and little or no radiation in other directions.

Phased-array antennas have found widespread use in military target acquisition radar systems. Such phased-array antennas permit the radar to be rapidly scanned electronically in three dimensions with no movement of the antenna elements. The outputs from the active antenna elements are formed into a steerable beam that can be used to detect and track multiple targets, such as satellites, missiles, aircraft and similar vehicles. Although usually complex and expensive, the phased-array radar has a gradual failure mode and can continue to function even if many individual elements fail.

System designers have available several technologies for accomplishing phase-shifter control for operation of phased-array antennas. Some phase shifters use ferrite materials while others use semiconductor devices, such as PIN diodes, field effect transistors and varactors. The operating mechanism in semiconductor phase shifters is essentially based upon the control of conduction and/or capacitance properties arising out of device doping characteristics. The operating mechanism of ferrite phase shifters usually depends on controlling its magnetic and/or high-current inductance properties. Control of ferroelectric material typically depends on controlling a voltage, which usually requires less current draw than what is needed to control other types of phase shifters. Because ferroelectric-based phase shifters operate under a fundamentally different principal than do semiconductor-based phase shifters, they have a number of distinct advantages over such devices.

Although semiconductor-based phase shifters, which usually employ transistors, are advantageously compact, they can be severely limited to only small signal applications. Attempts to employ high-power phase shifters of the semiconductor type often result in degrading the microwave characteristics of the antenna. Furthermore, small-signal phase shifters are usually subject to damage in the presence of strong signals, jamming signals, or electrical noise including electromagnetic pulses.

Ferrite-based phased arrays normally handle high power much better than most semiconductor devices and are less susceptible to damage in the presence of high-power signals and electromagnetic pulses. However, other features prevent the widespread use of ferrite-based phase shifters. First, each ferrite phase shifter of an assembly must usually be a separately manufactured module that must be electrically matched with other modules. These requirement can add greatly to overall assembly cost.

Second, ferrite-based phase shifters are normally unidirectional, which is acceptable for transmit-only or receive-only systems but is inferior for transmit-receive systems. A transmit-receive steerable array using nonreciprocal ferrite phase shifters would need double the number of phase-shifter elements that are needed for a system using reciprocal elements, thereby increasing system complexity and cost.

Third, control circuits for ferrite-based phase shifters typically include high-current magnetic coils that require high power. These coils can induce phase shifts even when the antenna is not scanning. Further, these high-impedance control circuits usually require individual impedance load matching to be executed after antenna production which can result in manufacturing delays. Also, there is normally a need for a large-gauge thickness in most ferrite phase-shifter substrates to handle the large power requirements without disintegrating or loosing signal fidelity.

Fourth, ferrite phase shifters are far more susceptible to environmental changes, such as ambient temperature and/or pressure changes, due to their high-current operation. Some calibration techniques that employ trimming to compensate for errors due to changing ambient conditions often find trimming to be extremely difficult or impossible to perform properly without degrading phase-shifter performance. Therefore, antenna calibration becomes more time dependent, lossy, and near impossible to realize using a ferrite-based antenna control.

Consequently, those concerned with the development of telecommunication systems that employ phased-array antennas have long recognized the need for improved phase-shifter controls that reduce their traditionally high costs and improve the poor performance of the manual, lossy calibration techniques associated with prior art systems. It is contemplated that an ideal phase-shifter control for a system that employs a phased-array antenna would be: capable of reciprocal signal propagation; operable at low-power levels; inexpensive to manufacture; light weight and compact; implemented with less complex circuitry and structure; less time dependent to calibration; capable of low-power trimming with unidirectional calibration; capable of high-speed calibration processing; and controllable with a low-power digital circuitry. The present invention fulfills this need.

SUMMARY OF THE INVENTION

It is therefore an object of the present invention to provide unique digital control and automatic calibration techniques for ferroelectric phase shifters that are used to steer phased-array antennas.

To attain this, the present invention contemplates a unique telecommunication system comprising a phased-array antenna having a plurality of spaced antenna elements for radiating and receiving a beam of radio frequency signals. A plurality of phase shifters each have one of its ends connected to a different one of the antenna elements. A signal processor system connects to the other ends of the phase shifters for processing the radio frequency signals. A data processor system controls the signal processor system, and connects to the phase shifters for controlling the relative phase shifts of the radio frequency signals propagating in the phase shifters.

The system further includes a manually operable beam steering control connected to the data processor system for inputting beam steering information. The data processor system is responsive to the beam steering control for controlling the relative phase shifts of the radio frequency signals propagating in the phase shifters. The system further includes a sensor circuit for sensing a parameter, such as temperature, of the phase shifters. The sensor circuit connects to the data processor system for inputting information that the data processor system responds to when controlling the relative phase shifts of the radio frequency signals propagating in the phase shifters.

When the phase shifters are ferroelectric phase shifters, the data processor system applies analog control voltages to the phase shifters for controlling the relative phase shifts. The beam steering control permits an operator to manually control the position of the beam in real time, or to effect automatic scanning and control the beam scanning rate by controlling the input of the beam steering information.

According to another aspect of the invention, there is provided a telecommunication method for radiating and receiving a beam of radio frequency signals with a phased-array antenna having a plurality of spaced antenna radiators. The method comprises the steps of generating a radio frequency signal, and propagating the radio frequency signal along a plurality of parallel phase-shifting paths with each of the phase-shifting paths having elements for regulating the amount of phase shift therein. The method includes feeding a different one the antenna radiators with the radio frequency signals propagating in a different one of the phase shifting paths. Further, the method contains the step of inputting beam steering information to a data processor system for controlling the elements for regulating the amount of phase shift in each of the paths.

BRIEF DESCRIPTION OF THE DRAWINGS

Other objects, features, details, advantages and applications of the invention will become apparent in light of the ensuing detailed disclosure, and particularly in light of the drawings wherein.

DETAILED DESCRIPTION OF THE PREFERRED EMBODIMENT

Figure 1:
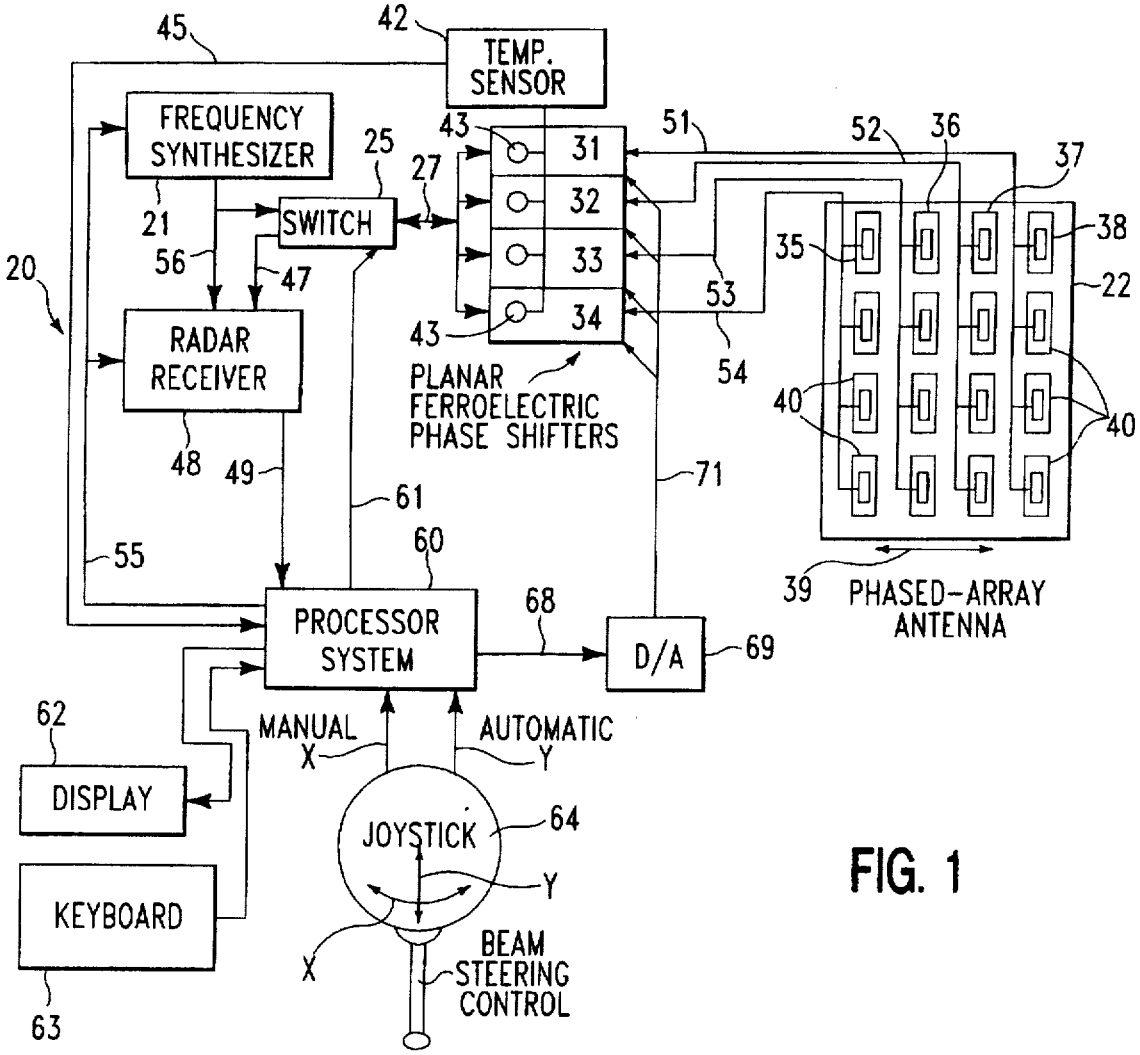
FIG. 1 is a system block diagram for a preferred embodiment of the invention.

Referring now to the drawings, there is shown in FIG. 1 a telecommunication system in the form of a phased-array radar 20. It is to be understood that radar 20 is only exemplary and that the present invention is applicable to a variety of other types of telecommunication systems. Radar 20 includes frequency synthesizer 21 for generating radio-frequency (rf) energy for transmission by phased array antenna 22. The output of frequency synthesizer 21 connects to transmission switch 25, which has input/output lines 27 that connect to the system ends of a set of planar ferroelectric phase shifters 31–34. Ferroelectric phase shifters 31–34 also have antenna ends that connect to phased-array antenna 22 via lines 51–54. Phase shifters 31–34 are reciprocal devices in that energy may travel in either direction between their antenna ends and system ends.

Phased-array antenna 22 has sixteen antenna elements 40 arrayed in four columns 35–38 with four elements 40 in each column. The four antenna elements 40 in each of columns 35–38 are joined in common and connect to a different one of the antenna ends of ferroelectric phase shifters 31–34 via lines 51–54, respectively. Although other variations are possible, it is assumed for this description that antenna elements 40 are conventional planar ferroelectric microwave radiators.

Processor system 60, which includes a conventional processor and an associated memory (not shown), has switch control output line 61 which connects to a control terminal of transmission switch 25. Conventional display monitor 62 also connects to processor system 60, as do the X and Y outputs of conventional joystick 64 and the output of standard keyboard 63. Lines 68 connect processor system 60 to digital-to-analog (D/A) converter 69, which has output lines 71 that connect to different ones of the phase-shift control terminals of phase shifters 31–34.

Temperature sensor circuit 42 connects to temperature sensors 43 which are mounted on each of phase shifters 31–34. Temperature sensor circuit 42 transmits temperature information to processor system 60 via line 45. The use of temperature sensors 43 in the preferred embodiment is only illustrative, and it is contemplated that other sensors that measure one or more additional ambient conditions that can effect the phase-shift accuracy of phase shifters 31–34, such as pressure, humidity, magnetic field, etc., may also be used.

Switch 25 further includes output lines 47 which connect to an input of radar receiver 48, which processes conventional radar signals before passing them to processor system 60 via line 49. Radar receiver 48 connects to frequency synthesizer 21 via line 56 to obtain a reference signal to be used for down-conversion of the received signals during signal processing. Processor system 60 transmits conventional control signals to radar receiver 48 and frequency synthesizer 21 via lines 55.

In general, phased-array radar 20 operates to transmit or receive radar signals via phased-array antenna 22. During a transmit period, processor system 60 operates transmission switch 25 to cause it to transmit rf energy generated by frequency synthesizer 21 to phase shifters 31–34 via parallel input lines 27. Processor system 60 also outputs phase-shift data to D/A converter 69, which converts that data into analog control voltages that are applied to the phase-shift control terminals of phase shifters 31–34. Phase shifters 31-34 respond by shifting the phase of the energy propagating therein as a function of the control voltages applied to their phase-shift control terminals. In general, each control voltage will be different and may vary at a predetermined rate, thereby causing phase shifters 31–34 to produce different and varying phase shifts that result in producing a narrow antenna beam pattern that scans a given field of view along the directions of double-headed arrow 39.

More specifically, during a transmit period, rf energy from phase shifters 31–34 drives antenna elements 40. Because columns 35–38 are appropriately spaced at a certain distance and are driven at different phases, a highly directional radiation pattern results that exhibits gain in some directions and little or no radiation in other directions. Consequently, the radiation pattern of phased-array antenna 22 will produce a focused beam that can be steered in the directions indicated by double-headed arrow 39 in a plane perpendicular to columns 35–38.

During a radar receive period, a reciprocal process takes place. Specifically, phased-array antenna 22 feeds received signals to the antenna ends of phase shifters 31–34 where they are shifted in phase. Processor system 60 operates transmission switch 25 so that these phase-shifted signals are passed to radar receiver 48 via lines 27 and 47. Only signals arriving at antenna elements 40 from a predetermined direction, determined by the relative phase shift imparted by phase shifters 31–34 and the spacing of antenna elements 40, will add constructively in receiver 48. Since, in general, processor system 60 varies the phase-shifter control voltages at a given rate, phase shifters 31–34 will produce corresponding relative phase shifts of the received signals. Consequently, antenna 22 will generally scan along the path indicated by the double-headed arrow 39. After radar receiver 48 detects the received signals in a conventional manner, it passes the detected information to processor system 60 for storage and display on display monitor 62, or for other processing.

Keyboard 63 and joystick 64 permit operator control of radar 20. An operator uses keyboard 63, in a conventional manner, to request processor system 60 to perform conventional radar functions, such as determining and displaying target locations, velocity, identification, etc. An operator initiates manual or automatic beam steering with joystick 64. The operator manually sets an antenna beam into a specific angular position by rotating the handle of joystick 64 into a corresponding angular position along its X direction, there being no signal on the Y output at this time. Processor system 60 responds to reception of the corresponding X output signal from joystick 64 by calculating an appropriate set of phase-shift data which is sent to D/A converter 69. D/A converter 69 converts the phase-shift data into analog control voltages that control the phase shifts of phase shifters 31–34. As described above, the resulting antenna beam pattern of antenna 22 will now be directed in accordance with the joystick X setting. To point the antenna beam in a particular direction, the operator simply holds joystick 64 in a corresponding position. Also, the operator may continuously move the handle of joystick 64, in which case the antenna beam will follow along and perform a corresponding real-time scanning of the antenna beam.

To perform automatic beam scanning, the operator moves the handle of joystick 64 in the Y direction. The degree of rotation in the Y direction of joystick 64 will determine the beam scanning rate. Processor system 60 responds to the Y output from joystick 64, regardless of the X output, by generating appropriate sets of phase-shift data at a rate determined by the Y output. The sets of phase-shift data are transmitted to D/A converter 69 which then generates sets of control voltages for application to phase shifters 31–34. This action causes the antenna beam pattern to continuously scan at a rate determined by the joystick Y setting. For example, a maximum antenna beam scanning rate would ensue when joystick 64 is fully deflected in the Y direction. Additionally, beam scanning at some minimum rate would ensue when the operator deflects joystick 64 to some predetermined minimum value in the Y direction. When the operator deflects joystick 64 below the minimum value in the Y direction, there would be no Y output and manual beam steering would be possible with appropriate deflections in the X direction.

Figure 2:
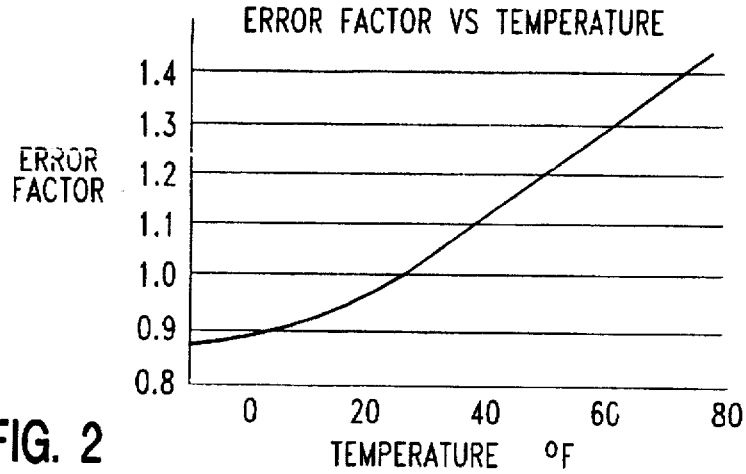
FIG. 2 is a graph of a phase-shifter calibration curve showing phase-shift error factor vs. temperature for use with the invention of FIG. 1.

In response to receiving data from temperature sensor circuit 42, processor system 60 performs automatic temperature calibration of phase shifters 31–34 before outputting phase-shift data on lines 68. As described above, conventional ferroelectric phase shifters can be sensitive to many ambient conditions, such as temperature, pressure, humidity, etc. It is contemplated in the present invention that appropriate sensors measure these ambient conditions and input appropriate data to processor system 60 for use in calibration of phase shifters 31–34. Specifically, processor system 60 is preloaded with a calibration function that represents the relationship between the ambient conditions, such as temperature, and calibration error factors that may be multiplied with basic phase-shift data to produce calibrated phase-shift data. FIG. 2 depicts a calibration curve that illustrates a relationship between temperature and calibration error factors for a set of typical planar ferroelectric phase shifters 31–34. Although the calibration function may be stored in processor system 60 in various forms, it is preferred that calibration polynomials be constructed and stored for more rapid real-time generation of the calibration error factors. The following equation represents an illustrative example of a polynomial that corresponds to the calibration curve of FIG. 2:

$$EF=(a+bT+cT^2+dT^3+eT^4)$$

where the coefficients have the following values: a equals 0.797116794; b equals 0.004336266; c equals 0.000114612; d equals $1.8994*10^{-6}$; and e equals $-1.958*10^{8}$; and EF and T are the calibration error factors and temperatures, respectively.

Therefore, using the temperature data input by temperature sensor circuit 42 on lines 45 and the internally stored calibration function, such as shown in the calibration curve of FIG.2 or the above corresponding polynomial, processor system 60 determines corresponding calibration error factors that are factor multiplied with basic phase-shift values that are calculated based only on the X and Y outputs of joystick 64 to obtain the phase-shift data which is output to D/A converter 69.

Figure 3:
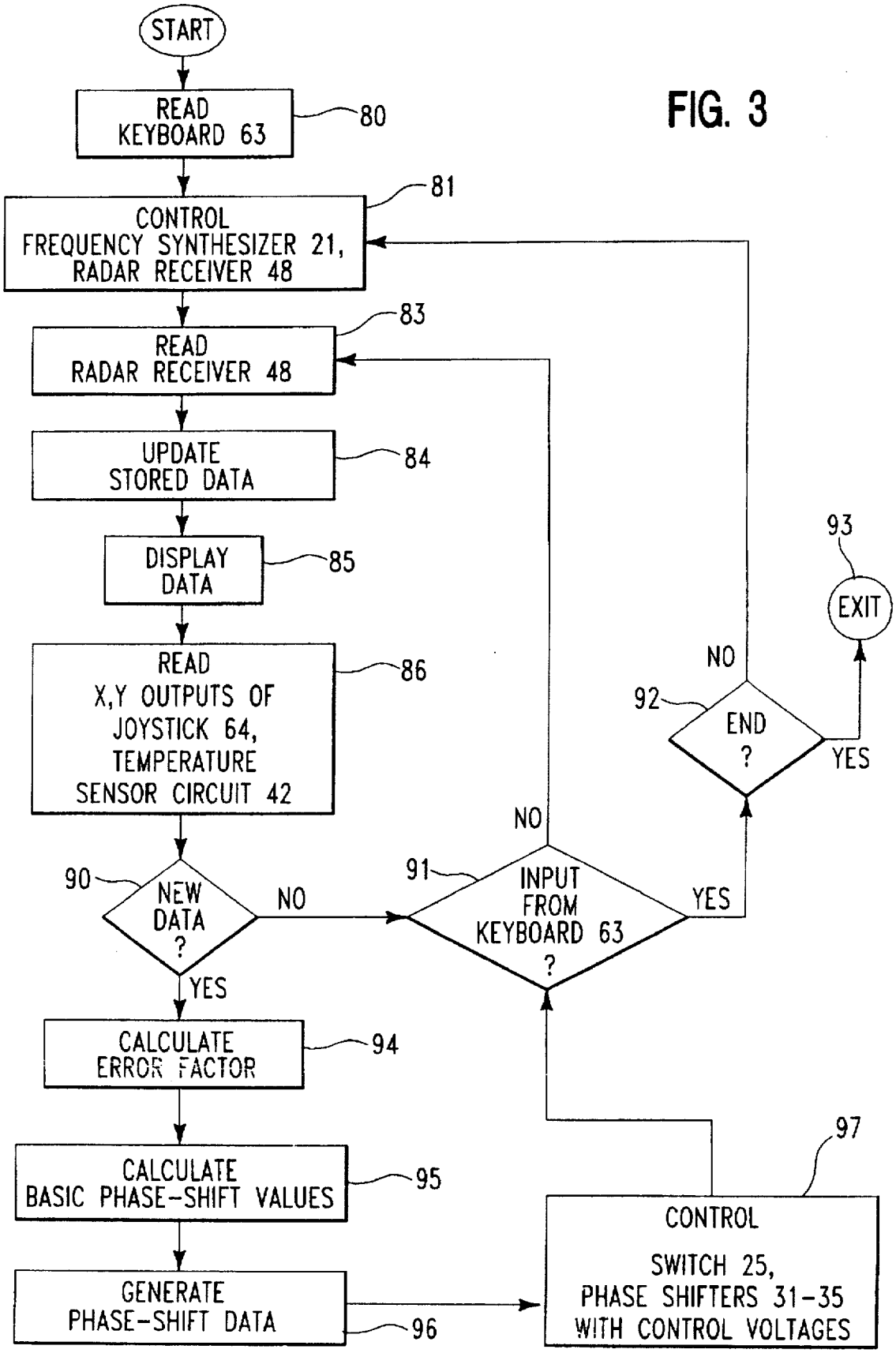
FIG. 3 is a flow diagram illustrating the process performed by the preferred embodiment of FIG. 1.

FIG. 3 is a processor flow diagram primarily illustrating the phase-shifter control functions of processor system 60. In response to an operator input from keyboard 63 as determined in read STEP 80, processor system 60, in control STEP 81, performs conventional control of frequency synthesizer 21 and radar receiver 48. Processor system 60 performs these control functions via lines 55. Additionally, radar receiver 48 uses the output of frequency synthesizer 21 to help process its input signals in a manner well known to those skilled in these arts.

Processor system 60 next reads the output of radar receiver 48, in read STEP 83, updates stored data, in update STEP 84, and displays appropriate data, e.g., radar information, on display monitor 62 in display STEP 85. Next, processor system 60 reads the X and Y outputs from joystick 64 and the temperature information from temperature sensor circuit 42 in read STEP 86. Processor system 60 then performs new-data decision STEP 90 to determine if the most recently read data in read STEP 86 is different from the previously stored data stored in update data STEP 84, or from default data at system startup. If the data read in read STEP 86 is not new, processor system 60 looks at its input data to determine, in decision STEP 91, if a new operator request has been made via keyboard 63. If the operator enters an exit command at keyboard 63, as determined in decision STEP 92, the process follows the yes path and exits at exit STEP 93. On the other hand, if the operator enters another command, such as a new transmit/receive request, processor system 60 returns to control STEP 81 to perform appropriate control of frequency synthesizer 21 and/or radar receiver 48. If in decision STEP 91 processor system 60 finds that no operator command was entered, it returns to read STEP 83 to read and update the received signals.

If in decision STEP 90 processor system 60 finds that the data read in read STEP 86 is new data, as compared to the most recently stored corresponding data (or default data at system startup), processor system 60 then proceeds along the yes path of decision STEP 90. Processor system 60 now performs polynomial calculations (or table lookup), in calculate STEP 94, to determine the calibration error factors based on the inputs from temperature sensor circuit 42 and the stored temperature calibration function (e.g., see the calibration curve in FIG. 2).

Based on the X and Y positions of joystick 64, processor system 60 next calculates, in calculate STEP 95, the basic phase-shift values for phase shifters 31–34. This calculation assumes that temperature has no effect on phase-shifter performance. In generate STEP 96, processor system 60 factor multiplies the basic phase-shift values and the calibration error factors to generate the phase-shift data and control voltages for use, in control STEP 97, in controlling phase shifters 31–34. Switch control signals are also applied to switch 25 in control STEP 97. Processor system 60 then proceeds to decision STEP 91 and the process continues as described above. The set of the most recent data read in read STEP 86 is stored in update STEP 84 for use in new-data decision STEP 90.

Obviously many modifications and variations of the present invention are possible in the light of the above teachings. As mentioned above, the inventive technique may be readily applied to different types of telecommunication systems that employ a variety of other types of phased array antennas. The number of antenna elements and, therefore, ferroelectric phase shifters could be increased considerably. The number of antennas could also be increased so that a two- or three-dimensional field of view could be scanned. However, those skilled in these arts will recognize from the above teachings that telecommunication systems having control, beam-forming, and automatic calibration capabilities for a ferroelectric phase shifting array can have the following desirable features: low-power voltage-controlled phase shifters for driving antenna elements; automatic, real-time calibration of ferroelectric phase-shift errors; and digital circuitry for beam construction and steering using ferroelectric phase shifters. Consequently, the telecommunications system of the present invention will be: relatively inexpensive to manufacture; capable of reciprocal signal propagation; operable at low-power levels; light weight, compact and less complex; and highly stable under adverse operating conditions such as rapidly changing temperatures, pressures and the like.

What is claimed is:

1. A temperature calibration system for a ferroelectric phase shifting array antenna comprising:

a phased-array antenna having a plurality of spaced antenna elements capable of radiating and receiving a beam of radio frequency signals;

a plurality of ferroelectric phase shifters each having one of its ends connected to a different one of said antenna element;

signal processing means connected to the other ends of said phase shifters for processing said radio frequency signals;

temperature sensing means;

data processor means for controlling said signal processing means, and connected to said phase shifters for controlling the relative phase shifts of said radio frequency signals propagating in said phase shifters, said data processor means including a calibration function means for calculating the relationship between temperatures sensed by the temperature sensing means and calibration error factors for the plurality of ferroelectric phase shifters, and including means to adjust the relative phase shifts of said radio frequency signals by factor multiplying the calibration error factors to the relative phase shifts; and beam steering control means connected to said data processor means for inputting beam steering information, and wherein said data processor means is responsive to said beam steering control means for controlling said relative phase shifts, and wherein the calibration function means calculates the relationship between temperature and calibration error factor by the following general equation:

$$EF=(a+bT+cT^2+dT^3+eT^4)$$

where a, b, c, d, and e, are coefficients, and EF and T are the calibration error factors and temperatures, respectively.

2. The system of claim 1 wherein said data processor means includes means for applying an analog control voltage to said phase shifters for controlling the relative phase shifts of said radio frequency signals propagating in said phase shifters.

3. The system of claim 2 wherein said data processor means includes a display monitor and said beam steering control means includes a manual control means for permitting an operator to manually control the position of said beam in real time by controlling the input of said beam steering information.

4. The system of claim 3 wherein said manual control means further permits an operator to control an automatic scanning rate of said beam.

5. A temperature calibration system for a ferroelectric phase shifting array antenna comprising:

a phased-array antenna having a plurality of spaced antenna elements capable of radiating and receiving a beam of radio frequency signals;

a plurality of phase shifters each having a ferroelectric means for propagating energy between first and second ends, said antenna elements connected to said first end of a different one of said phase shifters;

a signal processing means having a frequency synthesizer means for generating radio frequency energy to be radiated by said antenna and a receiver means for processing radio frequency energy received by said antenna;

a transmission switch means for connecting said signal processing means and said second ends of said phase shifters;

data processor means for controlling said signal processing means, said transmission switch means, and connected to said phase shifters for controlling the relative phase shifts of said energy propagating between said first and second ends, said data processor means including a calibration function means for calculating the relationship between temperatures sensed by the temperature sensing means and calibration error factors for the plurality of ferroelectric phase shifters, and including means to adjust the relative phase shifts of said radio frequency signals by factor multiplying the calibration error factors to the relative phase shifts; and beam steering control means connected to said data processor means for inputting beam steering information, and wherein said data processor means is responsive to said beam steering control means for controlling said relative phase shifts, and wherein the calibration function means calculates the relationship between temperature and calibration error factor by the following general equation:

$$EF=(a+bT+cT^2+dT^3+eT^4)$$

where a, b, c, d, and e, are coefficients, and EF and T are the calibration error factors and temperatures, respectively.

6. The system of claim 5 wherein said data processor means includes means for applying an analog control voltage to said phase shifters for controlling the relative phase shifts of said energy propagating in said phase shifters.

7. The system of claim 6 wherein said beam steering control means includes a joystick means for permitting an operator to manually control the position of said beam in real time or control an automatic scanning rate of said beam by operating said joystick means.

8. A method for calibrating radio frequency signals with a phased-array antenna having a plurality of spaced antenna radiators comprising the steps of:

generating a radio frequency signal;

propagating said radio frequency signal along a plurality of parallel phase-shifting paths, each said phase-shifting path having means for regulating the amount of phase shift in each of said paths, wherein said phase shifting paths include ferroelectric phase shifters;

feeding a different one said antenna radiators with said radio frequency signals propagating in a different one of said phase shifting paths;

inputting beam steering information to a data processor system for controlling said means for regulating the amount of phase shift in each of said paths;

sensing ambient temperature via a temperature sensing means;

calculating a relationship between ambient temperatures and calibration error factors; and factor multiplying relative phase shifts by the calibration error factor;

wherein said data processor system controls said means for regulating the amount of phase shift in each of said paths by applying analog control voltages to said phase shifters, and wherein the relationship between temperature and calibration error factor is calculated by the following general equation:

$$EF=(a+bT+cT^2+dT^3+eT^4)$$

where a, b, c, d, and e, are coefficients, and EF and T are the calibration error factors and temperatures, respectively.

9. The method of claim 8 wherein said inputting beam steering information includes manually controlling the position of said beam in real time by manually controlling the input of said beam steering information.

10. The method of claim 9 wherein said inputting beam steering information includes controlling an automatic scanning rate of said beam.

* * * * *